US011446681B2

(12) United States Patent
Beggs et al.

(10) Patent No.: US 11,446,681 B2
(45) Date of Patent: Sep. 20, 2022

(54) LIQUID RECIRCULATING VALVE

(71) Applicants: Robert Dale Beggs, Plainfield, WI (US); Kurt William Kamin, Plainfield, WI (US)

(72) Inventors: Robert Dale Beggs, Plainfield, WI (US); Kurt William Kamin, Plainfield, WI (US)

( * ) Notice: Subject to any disclaimer, the term of this patent is extended or adjusted under 35 U.S.C. 154(b) by 383 days.

(21) Appl. No.: 16/873,665

(22) Filed: Jun. 24, 2019

(65) Prior Publication Data

US 2021/0146382 A1 May 20, 2021

Related U.S. Application Data

(60) Provisional application No. 62/689,506, filed on Jun. 25, 2018.

(51) Int. Cl.
*B05B 1/30* (2006.01)

(52) U.S. Cl.
CPC ..... *B05B 1/3093* (2013.01); *B05B 1/3013* (2013.01)

(58) Field of Classification Search
CPC ... B05B 1/3093; B05B 1/3013; B05B 7/1404; B05B 7/0408; B05B 1/202
See application file for complete search history.

(56) References Cited

U.S. PATENT DOCUMENTS

| | | | | |
|---|---|---|---|---|
| 4,243,064 | A * | 1/1981 | Nolte | F16K 11/04 137/115.06 |
| 6,544,336 | B1 * | 4/2003 | Lopes | B05B 15/52 118/302 |
| 2014/0284400 | A1 * | 9/2014 | Hebbert | A01M 7/006 239/727 |
| 2015/0114494 | A1 * | 4/2015 | Crawford | B05B 7/1613 137/563 |
| 2015/0209835 | A1 * | 7/2015 | Heuckeroth | B05B 7/265 239/128 |
| 2017/0006852 | A1 * | 1/2017 | Engelbrecht | A01M 7/0053 |
| 2018/0325246 | A1 * | 11/2018 | Kovac | B05B 1/3093 |
| 2021/0146382 | A1 * | 5/2021 | Beggs | B05B 7/0408 |

* cited by examiner

*Primary Examiner* — Paul R Durand
*Assistant Examiner* — Bob Zadeh
(74) *Attorney, Agent, or Firm* — Brandon Carlin

(57) ABSTRACT

A liquid dispensing valve for dispensing of liquid solution, the liquid dispensing valve operable to create a vacuum buildup of pressure, such that the liquid moves on a recirculation path from the intake port to the output port. The recirculation of the liquid prevents sediment within the liquid from settling, and further prevents backpressure, and allows for continuous recirculation of the solution through a suction return line, providing generally consistent flow of liquid. The liquid dispensing valve's ability to minimize sediment buildup allows for a quick cleaning of the lines while also minimizing potential contamination of the general area.

20 Claims, 3 Drawing Sheets

LIQUID RECIRCULATING VALVE

CROSS REFERENCE TO RELATED APPLICATION

This application claims the benefit of U.S. Provisional Application No. 62/689,506, filed Jun. 25, 2018.

FIELD

The present disclosure relates generally to fluid operating systems, such as those used in the operation of an agricultural or industrial sprayer or sprayer machine.

INTRODUCTION

Industrial and agricultural sprayers apply liquids such as pesticides, fungicides, herbicides, water, fertilizers, and other liquids. The sprayers come in multiple formats, and may be found as a freestanding unit, a pull-behind sprayer that is hitched, dragged, or otherwise pulled by a tractor or other vehicle, or any other method.

When the sprayer applies a liquid upon a desired surface, the liquid runs through the sprayer's general system. Typically, the system will have a tank to hold the liquid, a feed line for the liquid to flow, and a spray boom, upon which is at least one spray nozzle, also known herein as a sprayer tip.

When the material to be sprayed is highly viscous, it may lose its heterogeneous nature over time in a sprayer system, as the substances may begin to separate, severely degrading efficacy. To combat this, recirculating boom systems have been introduced. A recirculating boom system sprays the material, and when the sprayer system is disengaged, the flow of material reverts, and the material returns to the tank. However, when the sprayer is applying dry flow-able powders, water soluble granules, clay based products, or other viscous material, the material moves back to the tank, but some of the material stays in the boom, and the spray nozzles, or sprayer tips, after time become clogged. The clogging of the spray nozzles severely reduces the efficacy of the sprayer. This requires the operator to respray to cover the missed areas, and the spray nozzles must be cleaned out to return to proper form and effectiveness.

After each use, it is preferred that a sprayer operator cleans out the lines of the sprayer system. This is generally required when switching between materials to be sprayed. Typically when an operator cleans out the lines on the boom, end caps on the boom lines are opened to allow the material to drain out. Any material left in the boom line will be flushed out with forcible ingress of water, and the material and water will circulate through the system and out the end cap. As can be appreciated and understood by those with skill in the art, the material egressing from the system can be contaminating to the ground below the cleaning operation, and the material egressing in this matter is usually wasted by the dilution of product during the cleaning process. Consequently, what is needed is a device which is able to recirculate the material in a sprayer line, and which can reduce the need for wasteful cleaning operations thereon.

SUMMARY OF THE PREFERRED EMBODIMENTS

The present disclosure is directed to a valve that aids in the recirculation and blending of solution to be sprayed by an industrial or agricultural sprayer. The recirculating valve may be easily retrofitted on existing sprayers or incorporated into newly designed sprayer systems. As used herein, the recirculating valve is alternatively known as a liquid dispensing valve or just as the valve. The names are interchangeable, as although the valve may be used to transport and direct the flow of a solution, it may also be used for the flow of a single substance liquid, and both are contemplated herein.

The valve is contemplated to be used at an inlet, or initial, stage of the sprayer. The sprayer is generally thought of herein as a piece of machinery with a liquid solution tank wherein the liquid solution to be sprayed is stored, preferably a boom section, or other way of holding up a spraying device, and at least one sprayer tip. Some examples of machinery are a heavy tractor, a large commercial truck, a personal vehicle, a bulldozer, or any other piece of heavy machinery capable of carrying sprayer material.

Connecting the liquid solution tank to the tip is a general supply line, also known generally as a hose upon which the valve is intended to be connected. Thus the liquid solution pours from the tank through the valve and finally to the sprayer tip or tips as the case may be. In some embodiments the intake port of the valve connects to the general supply line with a portion of the general supply line known as an intake hose removably attaching to the intake port. To facilitate a smooth connection, the intake port may contain screw threading. The type of threading will depend on the particularities of the intake hose threading, and it is presently thought that male threading would mate with a majority of intake hoses, but it is also contemplated that female screw threading might allow for better coupling and thus both versions are contemplated herein.

In a preferred embodiment, a liquid dispensing valve is provided with a casing body that provides rigid structure. The casing may be made of any rigid material such as a polymer or metal. The material of the casing is not important, but the material should be rigid and generally resistant to water or chemical damage to prevent the valve from being continuously replaced.

The valve casing includes an intake port, which is an opening to the inner cavity of the casing where the influx of the liquid solution from the tank is received. The intake port is located on the exterior of one side of the casing and flows towards the output port, which is located at a separate end of the casing.

The output port is located towards an end of the valve opposite the intake port, but it is not a requirement to be on the exact opposite casing side from the intake port. It is contemplated that the output port may be located near the opposite end of the intake port, but on a side casing wall similar to an L-shape without departing from the spirit of the invention, as it is contemplated that the exact shape of the valve may be customized to fit the specific type of boom sprayer or industrial application that the user desires. In at least one embodiment however, the output port is located on the opposite side casing of the intake port. It is contemplated that the output port will removably connect with a feed hose to or from the sprayer feed line which allows liquid solution to flow out the valve and towards the sprayer tip or tips. To facilitate a smooth connection, the output port may contain screw threading. The type of threading will depend on the particularities of the feed hose threading, it is presently thought that male threading would mate with a majority of intake hoses, but it is contemplated that female screw threading may allow for better coupling in some circumstances and thus both versions of screw threading are contemplated herein.

Connecting the intake port and the output port is a generally tubular main liquid passage. This main liquid passage is the route that the liquid solution takes upon entering the valve at the intake port position until traveling outside the valve at the output port position and flowing towards the sprayer tip(s). The generally tubular main liquid passage is not just a solid cylindrical tube however, as it additionally comprises a generally hourglass-shaped section.

In one embodiment the generally hourglass-shaped section is contemplated as a necked-down reduced diameter nozzle whereon the apex, or the tip of the nozzle, contacts an inverted reduced diameter nozzle, otherwise known as an extending diameter nozzle. The two apexes meet and the two nozzles form a generally hourglass-shaped portion. It need not be exact mirror-images, but the portion should neck down and then extend out again.

Additionally, there is provided a return port, otherwise known herein as the suction port. The suction port is where the return line or lines are connected, and provides an additional intake of the liquid. When the liquid enters into the valve from the suction port, it travels along a generally tubular suction liquid passage, which is thought to connect to a portion near the hourglass-shaped section. The combination of the return suction liquid flow and the hourglass-shaped section creates a vacuum-effect, and generates the circulating ability of the liquid.

Located between the hourglass-shaped section and the intake port is the first position of a generally tubular recirculation liquid passage. The second position of the recirculation liquid passage is located between the hourglass-shaped section and the output port. The vacuum created by the above-mentioned suction process combined with the hourglass shape will induce overflow liquid to move around the hourglass-shaped section and through the recirculation liquid passage from the first position to the second position. This additional movement of the material causes any sediment or granules in the liquid or solution to keep from building up and potentially settling, and also prevents the normal backpressure buildup associated with higher flow on sprayers. Due to preventing this buildup of contamination, clean out of the sprayer lines is easier and less contaminating to the area around which the user intends to clean out the sprayer lines.

In some embodiments of the present disclosure, a bypass valve port is provided. The bypass valve port is known herein as an optional port upon which an opening in the casing, if applicable, may be capped. The opening in the casing would allow a user to insert material, or the opening may also contain a relief valve. The relief valve is preferably spring-loaded, and is overlaid across the generally tubular recirculation passage. This feature allows for backfilled liquid solution to apply pressure on the spring-loaded relief valve, which allows the liquid solution access to the full recirculation passage. When in a low-flow situation, the liquid solution would not apply the requisite pressure to activate the spring-loaded relief valve and thus would not have access to the recirculation passage, moving solely through the main liquid passage.

Another optional component to the liquid dispensing valve is the additional of chemical injection ports. These chemical injection ports, or also properly named as accessory ports, allows for the user to add additional chemicals, oils, water, cleaners, granules, or other materials to the liquid solution as it is entering the valve. This allows for the user to quickly enhance the quality and effectiveness of the liquid solution to be sprayed.

An embodiment of the liquid dispensing valve may further contain a flow meter. The flow meter will allow for the ability to adjust and maintain a steady stream of flow quickly and accurately, as can be appreciated by those with skill in the art. While able to be placed in multiple positions in the liquid dispensing valve, it is contemplated that positioning one at a position just prior to the liquid solution entering the reduced diameter nozzle portion of the hourglass-shaped section would allow the user to monitor the influx of material from the accessory port, if applicable. A second position that may be utilized is at a position in the generally tubular main liquid passage just prior to entering the output port, otherwise known as just prior to egressing the liquid dispensing valve itself. This would allow the user to monitor the output flow of the liquid solution itself.

The suction port may be additionally equipped or mated with an additional connecting valve such as a tee valve, a three-way valve, a four-way valve, an elbow valve, an angled valve, or any other connecting valve which allows a sprayer's return hoses to be removably coupled to the liquid dispensing valve. In so doing, the sprayer return line will allow for additional influx of returned liquid solution that was not immediately sprayed to be rerouted back to the liquid dispensing valve. As will be described in detail further below, the liquid solution will ingress the valve through the suction port and through the generally tubular suction liquid passage. The liquid solution will engage with the hourglass-shaped section and be routed through the tubular main liquid passage in a direction of flow towards the output port. This allows for continuous recirculation of liquid solution, and prevents buildup of contamination and settling of any sediment. The return hoses are connected to the sprayer tip feed lines and induces backflow to move back towards the valve so as to be recirculated.

Various other features, advantages, and objects of the present disclosure will be made apparent from the following detailed description and any appended drawings herein.

BRIEF DESCRIPTION OF THE FIGURES

One or more preferred exemplary embodiments of the invention are illustrated in the accompanying drawings in which like reference numerals represent like parts throughout and in which.

Before explaining one or more embodiments of the invention in detail, it is to be understood that the invention is not limited in its application to the details of construction and the arrangement of the components as set forth in the following description or as illustrated in any appended drawings. The invention is capable of other embodiments and appearances, and may be practiced or carried out in various ways. Also, it is to be understood that the phraseology and terminology employed herein is for the purpose of description and should not be regarded as limiting.

DETAILED DESCRIPTION

Figure 1:
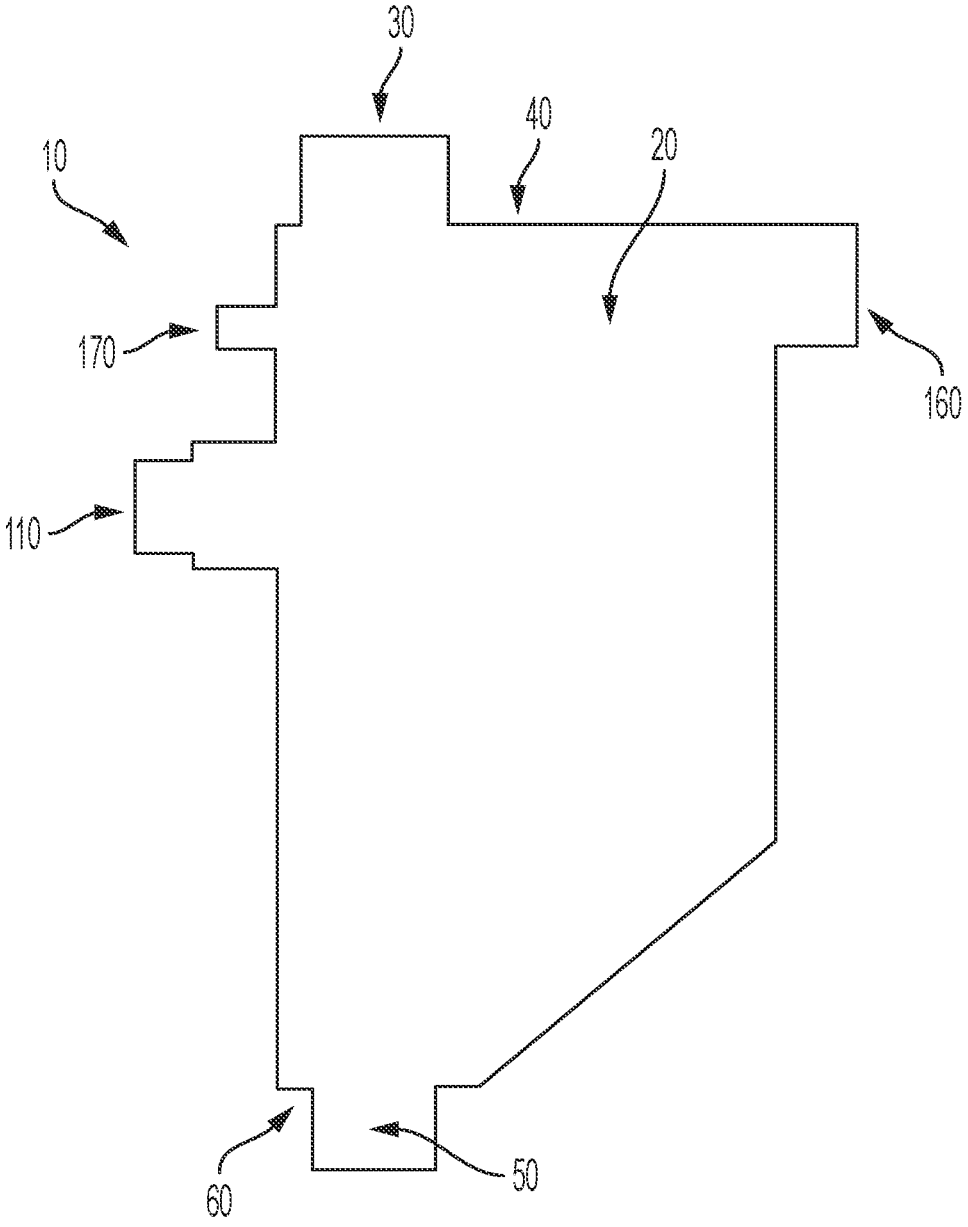
FIG. 1 is a perspective view of the liquid dispensing valve in accordance with some embodiments of the present disclosure.
Figure 3:
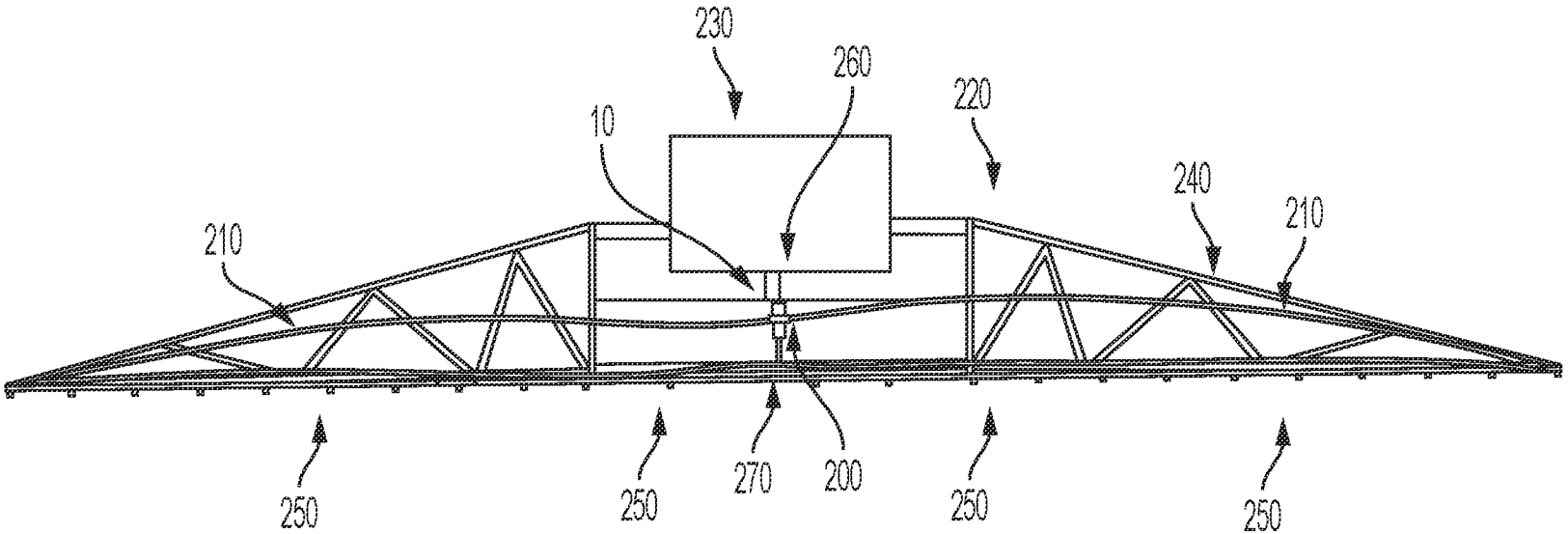
FIG. 3 is a perspective view of the liquid dispensing valve in use with a spraying boom application.

FIG. 1 illustrates a preferred embodiment of a liquid dispensing valve 10 constructed in accordance with the present disclosure. The liquid dispensing valve 10 is shown in a solid state with a casing 20, and having an intake port 30 located on a first side casing 40. As previously mentioned, the intake port 30 is where the initial influx of liquid solution enters the liquid dispensing valve 10 and thus is preferably positioned closest to the location of the Liquid Solution Tank 230, as depicted in FIG. 3. The output port 50 is illustrated here on the second side casing 60, which is known as a side of the casing opposite that of the first side casing 40. As described above, the output port 50 need not be located in the second side casing 60 exactly opposite that of the first side casing 40, as a location on a perpendicular side of the casing 20 but near the second side casing 60 would also not depart from the spirit of the present disclosure. Looking further at the liquid dispensing valve 10, a suction port 110 is depicted, which will allow for the recirculation of liquid solution into the valve 10, and this helps create a vacuum effect, as will be described further later. On a side of the casing 20 opposite that of the suction port 110 is shown a bypass valve port 160 which is an optional port which when provided allows a user to ingress the interior of the valve 10 or may help create a pressure relief if that is desired. Should the user not desire to do so, this bypass valve port 160, if provided, may be capped off. The bypass valve port 160 may be positioned on any side of the casing 20, and it may in fact be advantageous to place on an alternate side, should the situation dictate it best to do so. An optional accessory port 170 is also provided in this Figure, which is an area in which a user may add additional granules, chemicals, water, or the like to the liquid solution.

Figure 2:
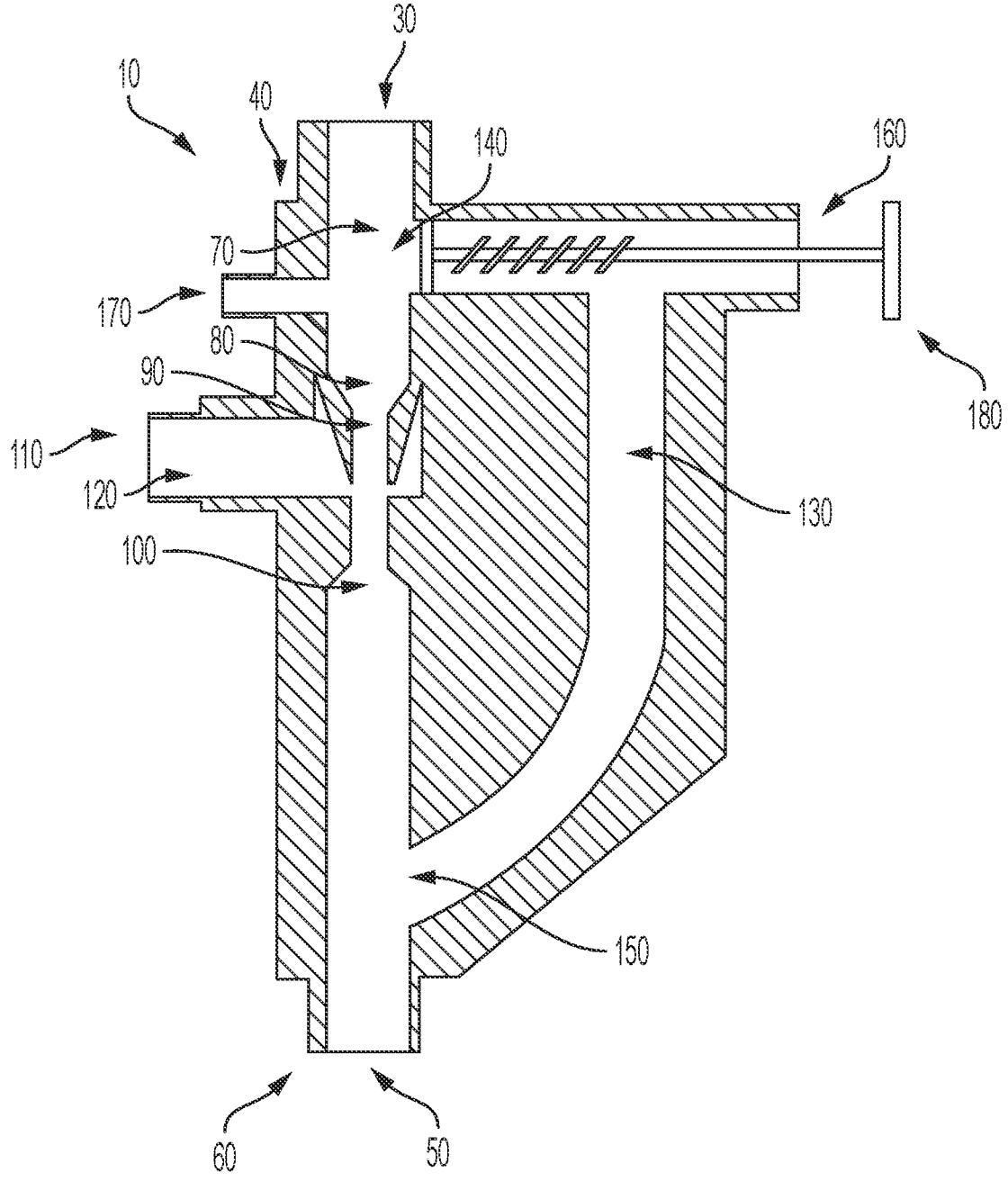
FIG. 2 is a sectional view of the liquid dispensing valve in accordance with some embodiments of the present disclosure.

Turning now to FIG. 2, a cross-sectional view of the liquid dispensing valve 10 according to a preferred embodiment of the present disclosure is shown. The intake port 30 is shown near a first side casing 40, and also highlights a generally tubular main liquid passage 70. When the liquid solution enters through the valve 10, it follows the generally tubular main liquid passage 70 and flows by gravity, or other pressure flow, towards a reduced diameter nozzle 90. This reduced diameter nozzle 90 restricts the flow of the liquid solution and in low-flow situations, the entirety of the liquid solution will travel to an extending diameter nozzle 100, the combination of which creates a section of the main liquid passage 70 known herein as the generally hourglass-shaped section 80. When the liquid solution passes through the hourglass-shaped section 80, it flows towards the output port 50 which is located near or on the second side casing 60. Also shown is a suction port 110, where the recirculated liquid solution returns to enter the valve 10. The suction port 110 features a generally tubular suction liquid passage 120 for the recirculated liquid solution to travel and which intersects with the hourglass shaped section 80, the combination of with which a vacuum effect is created on the liquid solution, particularly in a higher-flow situation. When the vacuum effect is created, incoming liquid solution that is entering the valve 10 through the intake port 30 backs up and begins to flow towards a first position 140 of the main liquid passage 70. The first position 140 is known herein as the location where a generally tubular recirculation liquid passage 130 intersects with the main liquid passage 70. The recirculation liquid passage 130 is presently thought to be a curved passage which allows the liquid solution to move around the hourglass-shaped section 80 of the main liquid passage 70 and reconnects with the main liquid passage 70 at a point nearer the output port 50 known herein as the second position 150. As described throughout, the reasoning for inducing the liquid solution in such a way is to prevent sediment buildup and also reduces backpressure buildup during high-flow operations. In some embodiments, the first position additionally features a spring-loaded relief valve 180, which prevents flow of liquid solution during low-flow operations. When the flow is increased, the pressure buildup near the hourglass-shaped section 80 increases, and thus the pressure of the liquid solution flow increases exponentially on the spring-loaded relief valve 180 as well. The spring loaded relief valve 180 will then move towards a bypass valve port 160, and allow access to the recirculation liquid passage 130. In such a way the intake of liquid solution to the valve 10, and any additional chemicals, water, cleaners, granules, or the like through an accessory port 170 will be continuously recirculated and allow for a cleaner, more efficient operation of the sprayer itself. Though not depicted, it is contemplated that a flow meter may be provided near the intake port 30 so as to monitor the intake flow rate of the liquid solution. It is further contemplated that a second flow meter may be provided in a passage near the output port 50 so as to monitor the flow of the liquid solution egressing the valve 10.

Looking to FIG. 3, a generic industrial or agricultural equipment piece 220 is depicted. This generic equipment piece 220 additionally comprises a sprayer boom 240, a liquid solution tank 230, and a plurality of sprayer tips 250. Underneath the liquid solution tank 230 is the liquid dispensing valve 10 according to one embodiment of the present disclosure, and there exists a intake hose 260 which is a line connecting the liquid solution tank 230 to the intake port 30 of the valve 10 itself. At the lower end of the valve 10 is shown a feed hose 270 which is a line removably connected to the output port 50 of the valve 10 where the liquid solution egresses the valve 10 and begins to move towards the sprayer tips 250. In this embodiment, the valve 10 additionally comprises a three-way valve, otherwise known as a tee-valve 200, which is connected to return hoses 210. This completes a circuit where the initial liquid solution exits the valve 10, moving towards the sprayer tips 250. The liquid solution that does not get sprayed immediately moves towards the return hoses 210 and reenters the valve, to be recirculated and reenter the feed hose 270. This recirculation circuit prevents the liquid solution from building up sediment near the sprayer tips 250 and clogging said tip nozzles.

Understandably, the present disclosure has been described above in terms of one or more preferred embodiments and methods. It is recognized that various alternatives and modifications may be made to these embodiments and methods that are within the scope of the present disclosure. It is also to be understood that, although the foregoing description and drawings describe and illustrate in detail one or more preferred embodiments of the present disclosure, to those skilled in the art of agricultural spraying, industrial spraying, heavy-machinery spraying, or in any other art to which the present disclosure relates, the present disclosure will suggest many modifications and constructions, as well as widely differing embodiments, applications and methods without thereby departing from the spirit and scope of the disclosure.

What is claimed is:

1. A liquid dispensing valve, said liquid dispensing valve comprising:

a casing having an intake port formed on a first side of said casing and an output port formed on a second side of said casing;

a tubular main liquid passage extending along an axis extending from the intake port to the output port wherein the tubular main liquid passage further comprises a hourglass-shaped section located between the intake port and output port, the hourglass-shaped section comprised of a reduced diameter nozzle and an extending diameter nozzle;

a suction port formed on a side of said casing, said suction port located perpendicular to the hourglass-shaped section of the tubular main liquid passage, further comprising a tubular suction liquid passage extending along an axis from the suction port to the hourglass-shaped section of the main liquid passage;

a tubular recirculation liquid passage disposed in a first position on the tubular main liquid passage, and further disposed in a second position on the tubular main liquid passage sandwiching the hourglass-shaped section of the tubular main liquid passage; and a bypass valve port formed on a side of said casing located opposite of the suction port, the bypass valve port extending perpendicularly from the tubular recirculation liquid passage.

2. The liquid dispensing valve of claim 1, wherein the casing further comprises an accessory port.

3. The liquid dispensing valve of claim 2, wherein the casing further comprises a plurality of accessory ports.

4. The liquid dispensing valve of claim 1, wherein the bypass valve port further comprises a spring-loaded relief valve.

5. The liquid dispensing valve of claim 1, wherein a flow meter is positioned in the tubular main liquid passage.

6. The liquid dispensing valve of claim 5, wherein an additional second flow meter is positioned in the tubular main liquid passage.

7. The liquid dispensing valve of claim 1, wherein the suction port additionally comprises a connecting valve.

8. The liquid dispensing valve of claim 7, wherein a return hose is provided having a first and second distal end, and the connecting valve is removably-connected with said return hose at the return hose's first distal end.

9. The liquid dispensing valve of claim 8, wherein a feed hose is additionally provided having a first and second distal end, said feed hose removably connected to the output port at the first distal end of the feed hose.

10. The liquid dispensing valve of claim 9, wherein a sprayer feed line is additionally provided, and wherein the feed hose is removably connected at said feed hose's second distal end to the sprayer feed line.

11. The liquid dispensing valve of claim 10, wherein the sprayer feed line additionally comprises a sprayer tip nozzle.

12. The liquid dispensing valve of claim 11, wherein the sprayer feed line additionally comprises a plurality of sprayer tip nozzles.

13. The liquid dispensing valve of claim 12, wherein the sprayer feed line is connected to the return hose at the second distal end of the return hose.

14. The liquid dispensing valve of claim 13, wherein the intake port additionally comprises male threading.

15. The liquid dispensing valve of claim 14, wherein the output port additionally comprises male threading.

16. The liquid dispensing valve of claim 15, wherein the connecting valve is a tee valve.

17. The liquid dispensing valve of claim 16, wherein the tee valve is connected to a plurality of return hoses.

18. A liquid solution dispensing system for recirculating and dispensing of liquid, said liquid solution dispensing system comprising:

a heavy machine having a liquid solution tank;

an intake hose having a first and second distal end, said intake hose removably connected to the liquid solution tank at the first distal end of the intake hose;

a liquid dispensing valve including a casing having an intake port and an output port, the intake port of the liquid dispensing valve removably connected to the second distal end of the intake hose, the liquid dispensing valve comprising:

a tubular main liquid passage extending along an axis extending from the intake port to the output port;

a hourglass-shaped section located within the tubular main liquid passage;

a suction port located perpendicular to the hourglass-shaped section, wherein a tubular suction liquid passage extends along an axis from the suction port to the main liquid passage, the suction port additionally comprising a connecting valve;

a tubular recirculation liquid passage disposed in a first position on the tubular main liquid passage extending to a second position on the tubular main liquid passage;

a bypass valve port formed on a side of the casing, the bypass valve port extending perpendicularly from the tubular recirculation liquid passage;

a spring-loaded relief valve positioned in the bypass valve port;

a feed hose having a first and second distal end, the feed hose first distal end removably connected to the output port of the liquid dispensing valve;

a sprayer feed line, removably connected to the second distal end of the feed hose;

a plurality of sprayer tips connected to the sprayer feed line; and a return hose having a first and second distal end, the first distal end of the return hose removably connected to the sprayer feed line, and the second distal end removably connected to the connecting valve of the suction port of the liquid dispensing valve.

19. The liquid dispensing system of claim 18, wherein the heavy machinery is a tractor.

20. The liquid dispensing system of claim 19, wherein the liquid dispensing valve additionally comprises chemical injection ports.

* * * * *